US006835013B2

(12) United States Patent
Dunn et al.

(10) Patent No.: US 6,835,013 B2
(45) Date of Patent: Dec. 28, 2004

(54) LABEL PRINTER

(75) Inventors: Anthony Roy Dunn, Cambridge (GB); Samuel Edward Cockerill, London (GB)

(73) Assignee: Esselte, Sint Niklaas (BE)

( * ) Notice: Subject to any disclaimer, the term of this patent is extended or adjusted under 35 U.S.C. 154(b) by 98 days.

(21) Appl. No.: 09/983,484

(22) Filed: Oct. 24, 2001

(65) Prior Publication Data

US 2002/0056383 A1 May 16, 2002

(30) Foreign Application Priority Data

Oct. 24, 2000 (GB) ..... 0026020
Jun. 29, 2001 (GB) ..... 0115994

(51) Int. Cl.[7] ..... B41J 11/26
(52) U.S. Cl. ..... 400/615.2; 400/83
(58) Field of Search ..... 400/611–615.2, 400/61–63, 70, 83

(56) References Cited

U.S. PATENT DOCUMENTS

| | | | | |
|---|---|---|---|---|
| 5,159,601 A | | 10/1992 | Huber | |
| 5,430,817 A | | 7/1995 | Vengsarkar | |
| 5,541,766 A | | 7/1996 | Mizrahi et al. | |
| 5,609,424 A | | 3/1997 | Sakuragi et al. | 400/61 |
| 5,816,717 A | * | 10/1998 | Beadman et al. | 400/83 |
| 5,857,789 A | * | 1/1999 | Day et al. | 400/415.2 |
| 5,871,293 A | * | 2/1999 | Kano | 400/615.2 |
| 5,920,684 A | * | 7/1999 | Hastings et al. | 358/1.13 |
| 5,987,200 A | | 11/1999 | Fleming et al. | |
| 6,097,862 A | | 8/2000 | Abramov et al. | |
| 6,104,492 A | | 8/2000 | Giles et al. | |
| 6,108,470 A | | 8/2000 | Jin et al. | |
| 6,141,470 A | | 10/2000 | Espindola et al. | |
| 6,144,486 A | | 11/2000 | Bennett et al. | |
| 6,151,157 A | | 11/2000 | Ball et al. | |
| 6,208,793 B1 | | 3/2001 | Hillmer et al. | |
| 6,275,629 B1 | | 8/2001 | Eggleton et al. | |
| 6,292,292 B1 | | 9/2001 | Garito et al. | |

FOREIGN PATENT DOCUMENTS

| | | | | |
|---|---|---|---|---|
| EP | 0 628 419 A2 | | 12/1994 | |
| EP | 0 737 587 | | 10/1996 | |
| EP | 0 768 611 A2 | | 4/1997 | |
| EP | 0 855 282 A2 | | 7/1998 | |
| EP | 0 873 875 | | 10/1998 | |
| EP | 0 947 339 A2 | | 10/1999 | |
| JP | 62238769 A | * | 10/1987 | ..... B41J/5/30 |
| WO | WO 99/38692 | | 8/1999 | |

* cited by examiner

*Primary Examiner*—Minh Chau
(74) *Attorney, Agent, or Firm*—Morgan, Lewis & Bockius LLP

(57) ABSTRACT

A label printer for printing a label, the printer comprising: input means for inputting data defining labels to be printed; storage means for storing a plurality of labels, labels being separated in said storage means by label indicators; selection means for selecting at least one of said labels to be displayed at a display of the label printer; and means for controlling only said selected label to be displayed in dependence on the location of label indicators defining the limits of said selected label.

41 Claims, 5 Drawing Sheets

LABEL PRINTER

FIELD OF THE INVENTION

The present invention relates to a label printer and in particular but not exclusively to a tape printing device for printing an image on a tape.

BACKGROUND OF THE INVENTION

Known tape printing apparatus of the type with which the present invention is concerned are disclosed in EP-A-322918 and EP-A-322919 (Brother Kogyo Kabushiki Kaisha) and EP-A-267890 (Varitronic). The printers each include a printing device having a cassette receiving bay for receiving a cassette or tape holding case. An EP-A-26890, the tape holding case houses an ink ribbon and a substrate tape, the latter comprising an upper image receiving layer secured to a backing layered by an adhesive. In EP-A-32218 and EP-A-322919, the tape holding case houses an ink ribbon, a transparent image receiving tape and a double sided adhesive tape which is secured at one of its adhesive coated sides to the image tape after printing and which has a backing layer peelable from its other adhesive coated side. With both these apparatus, the image transfer medium (ink ribbon) and the image receiving tape (substrate) are in the same cassette.

It has also been proposed by the present applicants in, for example, EP-A578372 to house the ink ribbon and the substrate tape in separate cassettes.

In all of these cases, the image receiving tape passes in overlap with the ink ribbon to a print zone consisting of a fixed print head and a platen (or vice versa) against which the print head can be pressed to cause an image to transfer from the ink ribbon to the image receiving tape. There are many ways of doing this, including dry lettering or dry film impression, but the most usual way currently is by thermal printing where the print head is heated and the heat causes ink from the ink ribbon to be transferred to the image receiving tape.

The edit buffers of known printers store one long line of characters relating to a single label. The edit buffers stores characters as they are input by a user and in known tape printers stores only the current label. However the edit buffer is generally much longer than the average label. For example, one known edit buffer is able to accommodate 70 characters.

However, for certain applications the average label is between 5 to 15 characters. This has the disadvantage that this is not a particularly efficient use of the memory space provided by the edit buffer.

In some uses, a tape printer is used to print the same labels over a period of time. For example a user's name, company name, address, project name, foodstuff for storage or the like may be printed regularly. Memory functions may be provided to store commonly used labels. However, the procedure for storing labels is often relatively complicated and may deter some users from making use of the memory facility. The procedure for recalling the correct label may be time consuming particularly where a number of labels are stored. A further disadvantage is that additional memory space would need to be provided for this storage function. If no memory function is provided, the user has to enter and delete the same labels over and again as only one label can exist in the tape printer at the same time.

SUMMARY OF THE INVENTION

It is an aim of embodiments of the present invention to address particularly the problem mentioned above in relation to recalling and displaying correct labels, particularly but not exclusively where display space is limited.

According to the present invention there is provided a label printer for printing a label, the printer comprising:

- input means for inputting data defining labels to be printed;
- storage means for storing a plurality of labels, labels being separated in said storage means by label indicators;
- selection means for selecting at least one of said labels to be displayed at a display of the label printer; and
- means for controlling only said selected label to be displayed in dependence on the location of label indicators defining the limits of said selected label.

Preferably the selected label is displayed by scrolling the text of the label from right to left across the display such that a user can read the entire label even where display space is limited.

An additional view function can be provided whereby all of the labels in said storage means are displayed by scrolling in a direction from right to left across the display, notwithstanding the label indicators.

According to another aspect of the invention there is provided a method of displaying contents of a label memory which holds a plurality of labels, the method comprising:

- selecting one of said labels at a display;
- detecting a first label indicator in the label memory and commencing a scrolling operation at said first label indicator to scroll the contents of the label from right to left across the display; and
- terminating the scrolling operation on detection of a subsequent label indicator defining the end of the selected label.

According to another aspect of the present invention there is provided a label printer for printing a label, said printer comprising input means for inputting labels to be printed memory means for storing a plurality of labels, said memory means being arranged to store said labels as said labels are input; selection means for selecting at least one of said labels to be printed; and printing means for printing said at least one selected label.

BRIEF DESCRIPTION OF DRAWINGS

For a better understanding of the present invention and as to how the same may be carried into effect, reference will now be made by way of example to the accompanying drawings in which.

DETAILED DESCRIPTION OF PREFERRED EMBODIMENTS

Figure 1:
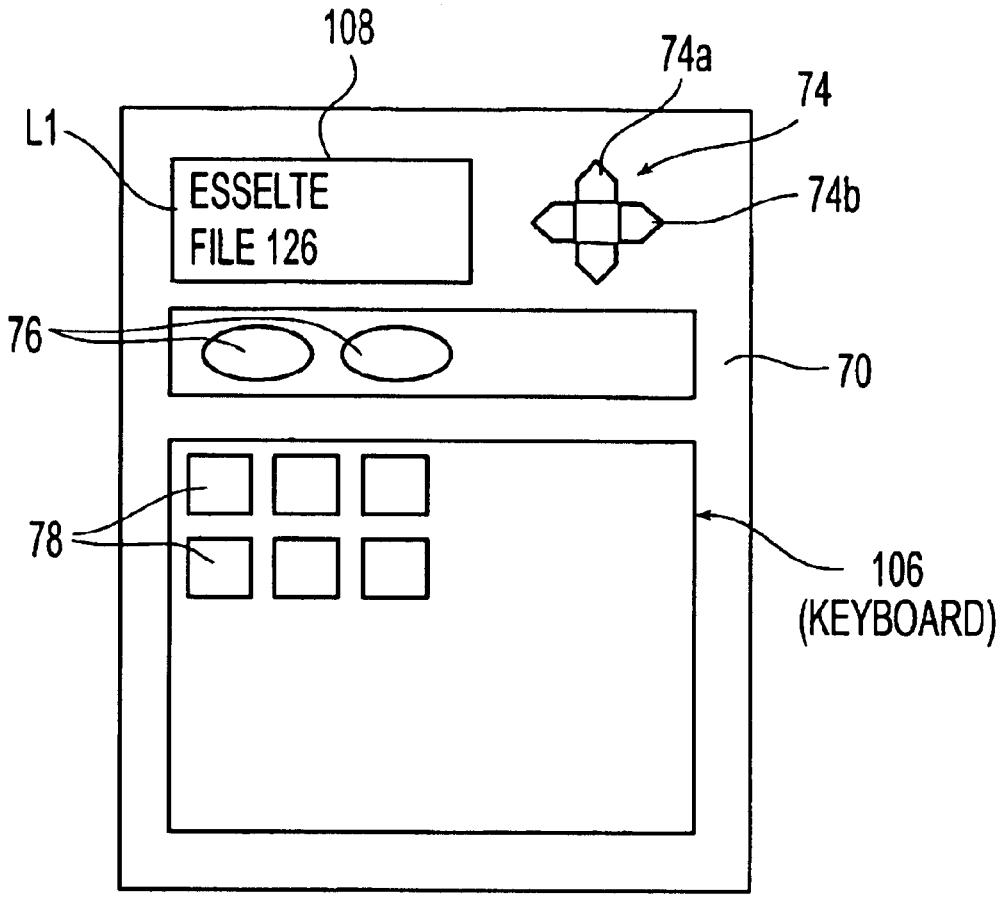
FIG. 1 is a schematic diagram of the front part of the casing of a printing device

FIG. 1 illustrates the front of a tape printing device. Reference numeral 70 denotes the casework of the printer.

The front of the printer carries a liquid crystal display (LCD) 108 and a keyboard 106 having a plurality of cursor control keys 74, a plurality of function keys 76, only two of which are illustrated in FIG. 1, and a plurality of character selecting keys 78, only six of which are illustrated in FIG. 1. The keyboard 106 is used for inputting characters to the tape printing device. This could be achieved with other input means, for example a touch pad or a touch screen. The function keys include a return key, a label delimiter key, a delete key, an edit key and a print key. The label delimiter key will be described in more detail hereinafter. An alternative embodiments of the invention additional and/or alternative functions may be provided. As is known, combinations of keys can be used in place of individual keys for each function. The display can display two lines of text. Other embodiments may be able to display more or less than two lines of text. The display is illustrated displaying a two line label (L1) ESSELTE (first line) FILE. 126 (second line). As is known, the character selecting keys 78 allow characters to be selected by a user to formulate labels to be printed. The term "characters" in the following refers to numerals, symbols, icons, background patterns, barcodes and similar as well as text characters, which together may make up an image to be printed on a label. The function keys 76 allow different functions to be implemented, and in effect control the operational modes of the printer.

The printer operates with a supply of tape on which images are printed. Lengths of the tape are cut off after a label has been printed. The tape is housed in a cassette which is held in a cassette bay.

Typically, this tape printing device 1 is a hand held or small desk top device which is powered by batteries at least part of the time. Alternatively, the tape printing device may be supplied with power from a main supply.

Figure 2:
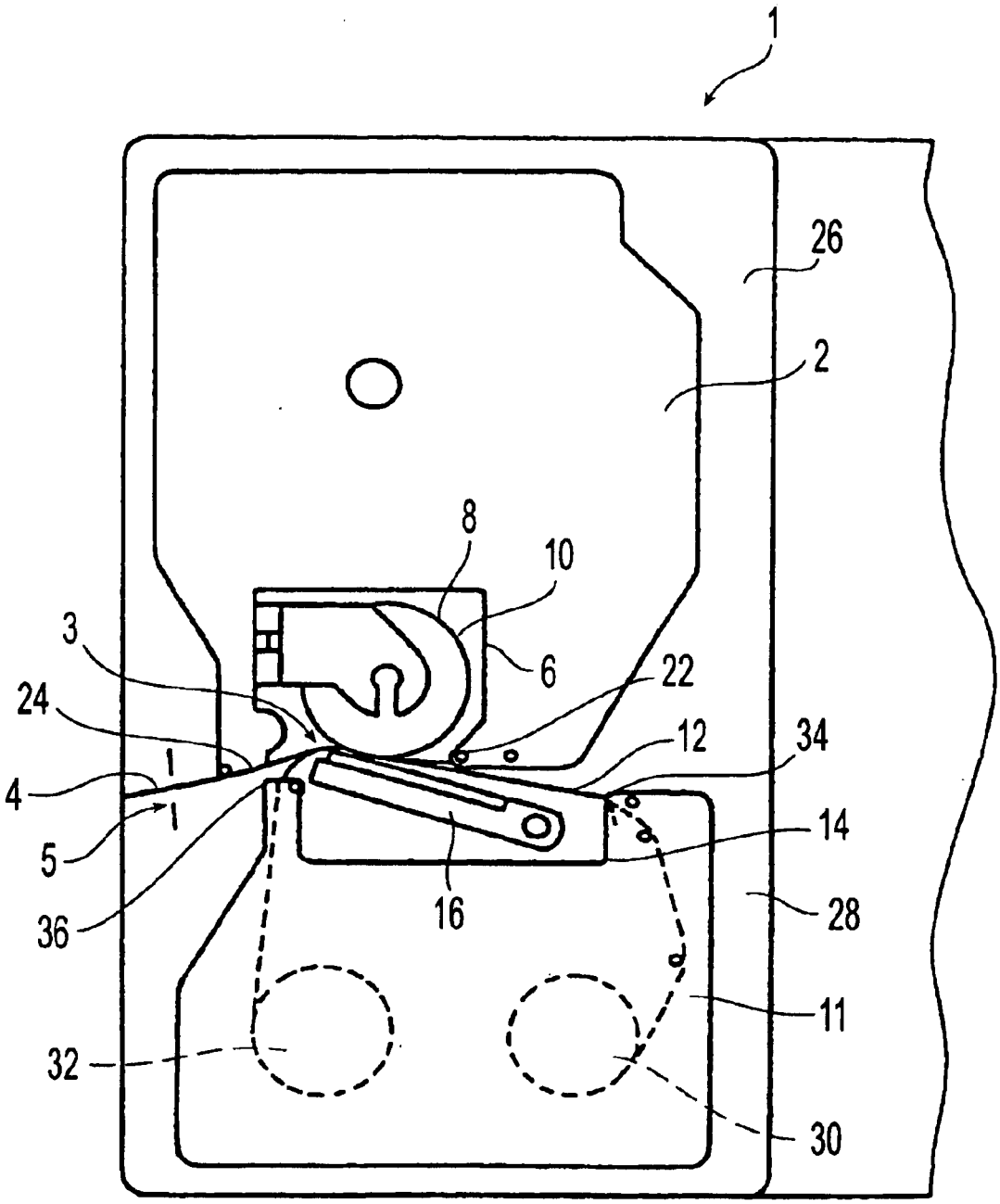
FIG. 2 is a plan view of a first tape printing device embodying the present invention using a two cassette system.

FIG. 2 shows in plan view, with the outer casing depicted in FIG. 1 removed, the first tape printing device embodying the present invention which has two cassettes arranged therein. The upper cassette 2 is located in a first cassette receiving portion 26 and contains a supply of image receiving tape 4 which passes through a print zone 3 of the tape printing device 1 to an outlet 5 of the tape printing device 1. The image receiving tape 4 comprises an upper layer for receiving a printed image on one of its surfaces and has its other surface coated with an adhesive layer to which is secured a releasable backing layer. The upper cassette 2 has a recess for accommodating a platen 8 of the tape printing device 1, and guide portions 22 and 24 for guiding the tape through the print zone 3. The platen 8 is mounted for rotation within a cage moulding 10. Alternatively the platen could be mounted for rotation on a pin.

The lower cassette 11 is located in a second cassette receiving portion 28 and contains a thermal transfer ribbon 12 which extends from a supply spool 30 to a take up spool 32 within the cassette 11. The thermal transfer ribbon 12 extends through the print zone 3 in overlap with the image receiving tape 4. The cassette 11 has a recess 14 for receiving a print head 16 of the tape printing device I and guide portions 34 and 36 for guiding the thermal transfer ribbon 12 through the print zone 3. The print head 16 is movable between an operative position shown in FIG. 1, in which it is in contact with the platen 8 and holds the thermal transfer ribbon 12 and the image receiving tape 4 in overlap between the print head 16 and the platen 8 and in an inoperative position in which it is moved away fro the platen 8 to release the thermal transfer ribbon 12 and image receiving tape 4. In the operative position, the platen 8 is rotated to cause the image receiving tape 12 to be driven past the print head 16 and the print head 16 is controlled to print an image on the image receiving tape 4 by thermal transfer of ink from the ribbon 12.

The tape printing device 1 has a lid (which is not shown) but which is hinged along the rear of the cassette receiving portions 26 and 28 and which covers both cassettes when in place. The lid may of course be hinged to the tape printing device in any other suitable way. In alternative embodiments of the invention, the lid may not be hinged but may be attached to the tape printer; when required, in any other suitable way, A DC motor 7 (see FIG. 4) continuously drives the platen 8. The platen is arranged to drive the image receiving tape 4 through the print zone 3 by the actuation of its own rotation.

The image is printed by the print head 16 on the image receiving tape on a column by column basis with the columns being adjacent one another in the direction of movement of the tape 4.

Figure 3:
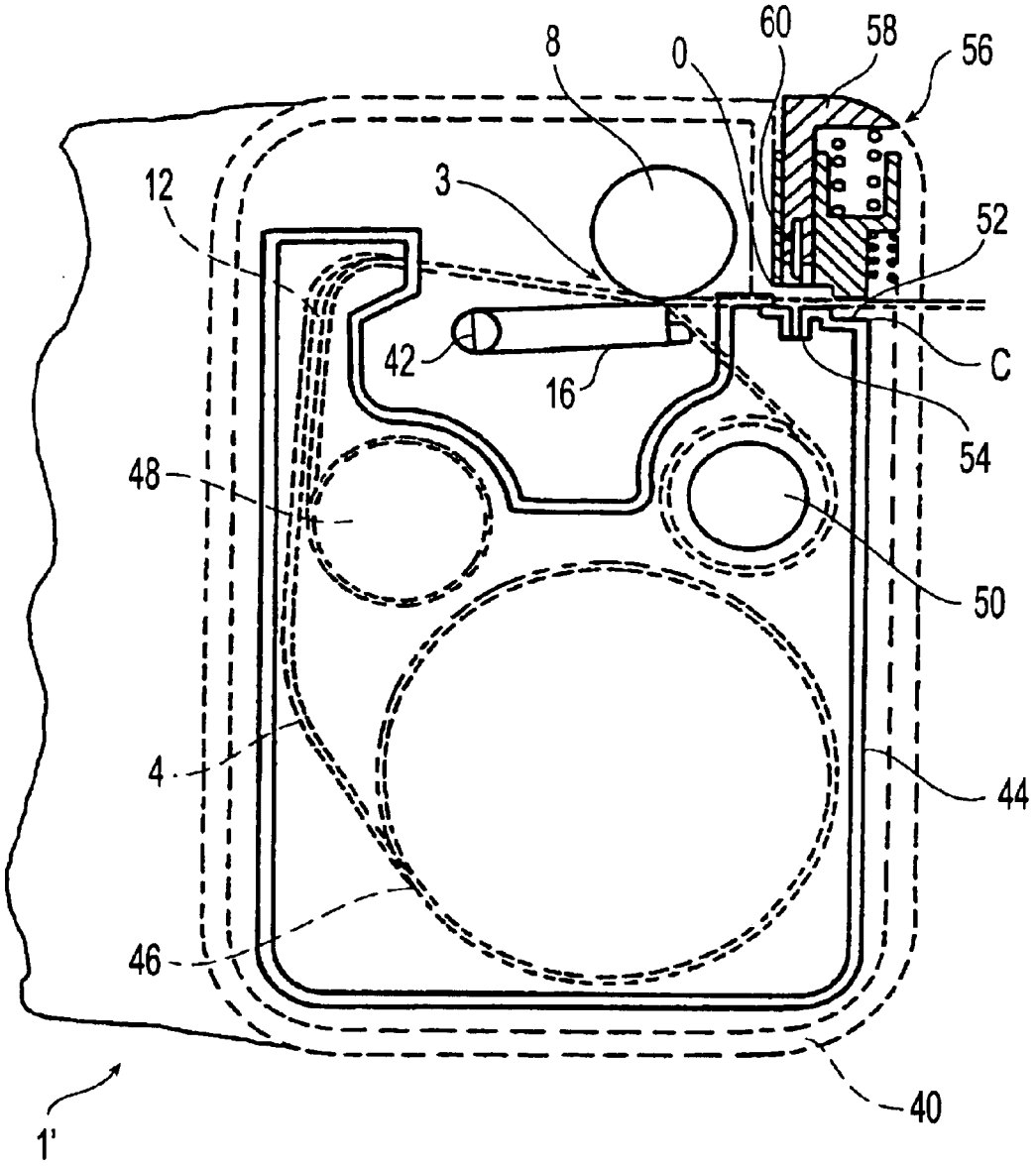
FIG. 3 is a plan view of a second tape printing device embodying the present invention, using a one cassette system.

FIG. 3 illustrates in plan view a cassette bay of a second printing device 1 embodying the present invention which uses a one cassette system. It has its outer casing as depicted in FIG. 1 removed. Like reference numerals are used for those parts which are also shown in FIG. 2. The cassette bay is shown by the dotted line' 40. The cassette bay 40 includes a thermal print head 16 and a platen 6 which cooperate to define a print zone 3. The thermal print head 16 is the same as that discussed in relation to FIG. 2.

The print head is pivotable about a pivot point so that it can be brought into contact with the platen 8 for printing and moved away from the platen 8 to enable the cassette to be removed and replaced as in the first embodiment. A cassette inserted into the cassette bay 40 is denoted generally by reference numeral 44. The cassette 44 holds a supply spool 46 of image receiving tape 4. The image receiving tape 4 is guided by a guide mechanism (which is not shown) through the cassette 44, cut of the cassette 44 through an outlet 0 past the print zone 3 to a cutting location C. The same cassette 44 also has an ink ribbon supply spool 48 and an ink ribbon take up spool 50. The ink ribbon 12 is guided from the ink ribbon supply spool 48 through the print zone 3 and taken up on the ink ribbon take up spool 50. As with the first embodiment, the image receiving tape 4 passes in overlap with the ink ribbon 12 through the print zone 3 with its image receiving layer in contact with the ink ribbon 12.

The platen of this second embodiment is also driven by a motor 7. The motor rotates to drive the image receiving tape through the print zone 3 continuously during printing. In either of the embodiments, it is possible that the tape be driven in a step wise manner by a stepper motor.

An image is printed on the tape fed out from the print zone to the cutting location C which is provided at a location in a portion of the wall of the cassette 44 which is close to the print zone 3. The portion of the wall on the cassette 44 where the cutting location C is defined is denoted by reference 52. A slot 54 is defined in the wall portion 52 and the image receiving tape 4 is fed past the print zone 3 to the cutting location C where it is supported by facing wall portions on either side of the slot 54.

The second tape printing device 1' includes a cutting mechanism 56 including a cutter support member 56 which carries a blade 60. The blade 60 cuts the image receiving tape 4 and then enters the slot 54. It should be appreciated that the first embodiment will usually also include a cutting mechanism.

The ink ribbon can be omitted in certain embodiments where the image receiving tape is of a thermally sensitive material. In this case, the image is printed by the thermal print head directly onto the thermally sensitive image receiving tape.

Figure 4:
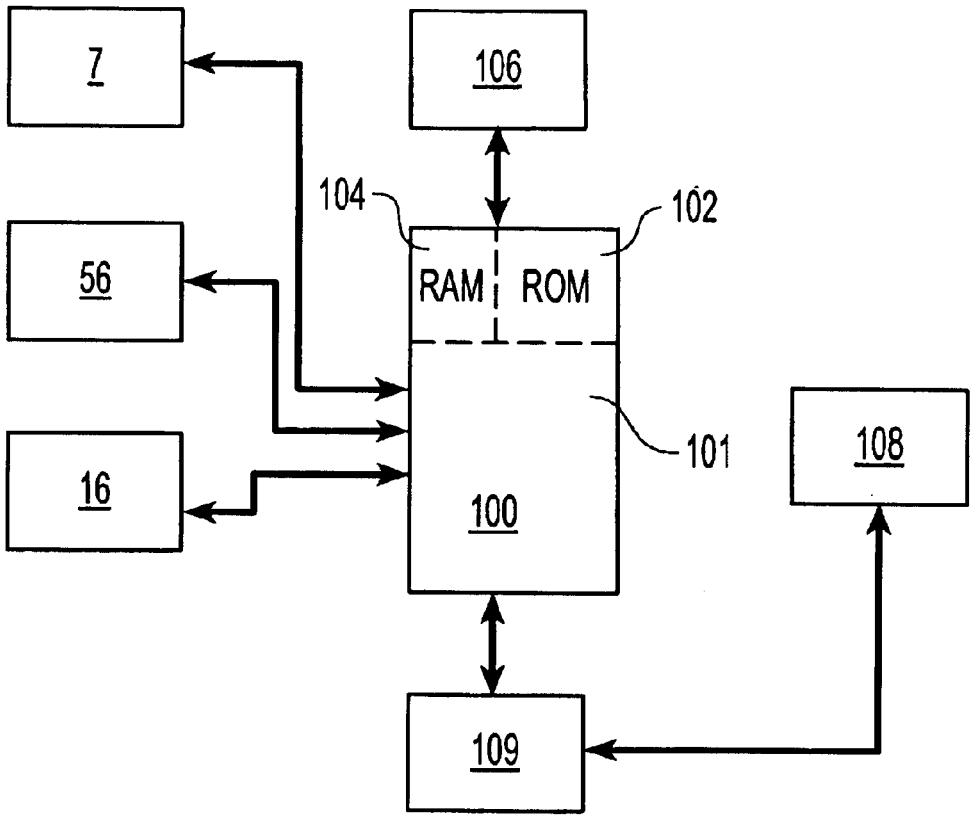
FIG. 4 is a diagrammatic sketch showing the control circuitry for the printing device of FIG. 2 or of FIG. 3.

Basic circuitry for controlling the tape printing device 1 of FIG. 2 or the tape printing device 1' of FIG. 3 is shown in FIG. 4. There is a microprocessor chip 100 having a read only memory (ROM) 102, a microprocessor 101 and random access memory capacity indicated diagrammatically by RAM 104. The microprocessor chip 100 is connected to receive label data input to it from a data input device such as a keyboard 106. The microprocessor chip 100 outputs data to drive a display 108 via a display driver chip 109 to display a label to be printed (or a part thereof) and/or a message for the user. The display driver alternatively may form part of the microprocessor chip. Additionally, the microprocessor chip 100 also outputs data to drive the print head 16 so that the label data is printed onto the image receiving tape to form a label. Finally, the microprocessor chip 100 also controls the motor 7 for driving the platen. The microprocessor chip 100 may also control the cutting mechanism 56 of FIG. 3 or a cutting mechanism of FIG. 2 to allow a length of tape to be cut off. In alternative embodiments at least part of the cutting mechanism may be manually operated.

Figure 5:
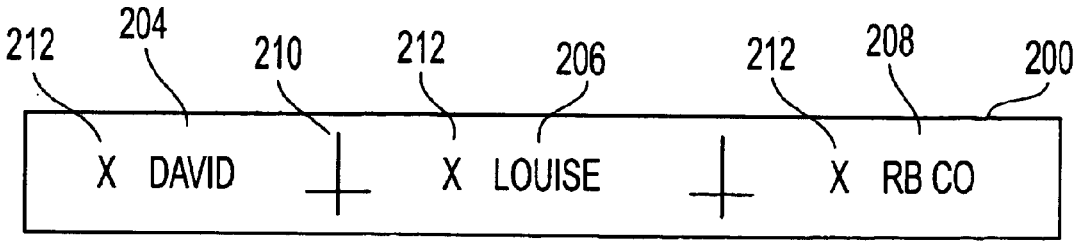
FIG. 5 is a schematic view of an edit buffer used in embodiments of the invention.

Reference is made to FIG. 5 which shows a schematic drawing of an edit buffer 200. The edit buffer may be part of the RAM 104 or may be separate therefrom. For example, the edit buffer 200 may be provided on a separate chip. The edit buffer 200 is arranged to store a number of different labels 204-8 at the same time. In preferred embodiments of the present invention, the number of labels is limited only by the capacity of the edit buffer. If the labels are relatively short, then a relatively large number of labels can be stored at one time in the edit buffer. If on the other hand, the labels are relatively long, then the number of labels which can be stored at one time in the edit buffer will be relatively small.

In alternative embodiments of the invention, a maximum number of labels may be allowed. For example, in one embodiment of the invention the maximum number of labels which can be stored is 20. This is of course subject to there being sufficient room in the buffer. The number of labels stored in the buffer is determined by the number of label indicators, which will be described in more detail hereinafter, stored in the buffer. If the maximum number of labels permitted is n, then the maximum number of label indicators permitted may be n−1.

In some embodiments of the present invention, the tape printer may have two modes of operation. In the first mode of operation, the edit buffer 200 is only permitted to have a single label in it at one time. In the second mode of operation, the edit buffer is permitted to contain more than one label at the same time. In alternative embodiments of the present invention, the tape printer will always operate in the second mode described above.

In order to start entering a new label, the user inputs a new label indicator 210. This new label indicator 210 can be input in any appropriate manner. For example, the keyboard may have a label delimiter key or button which when actuated by the user provides an indication that a new label is to be commenced. This label delimiter key or button can be actuated on its own or in conjunction with one or more keys such as a shift key or the like. In alternative embodiments of the present invention, a series of key strokes or the like may be required ir order to begin a new label. In an further alternative embodiment of the present invention, one of more selections from displayed menus may be made in order to start a new label.

In a further embodiment, the new label indicator may be added automatically to the end of the buffer, when the last label is printed and there is no delimiter at the end of the buffer already. Additionally the cursor could be moved to the position after this new label indicator so that the user is in the correct position to enter the text for the next label.

So that a user is able to see that a new label has been started, a label indicator 210, which can take the form of character or characters or a symbol or symbols, may be displayed on the display. The indicator 210 may be displayed in a different way to the input label.

The indicator 210 also provides an indication that the preceding label has ended. In alternative embodiments of the present invention, a separate indicator may be provided to indicate the end of a label.

The indicator 210 is also stored in the edit buffer 200 and allows the tape printer to determine where a label begins and ends.

The process for entering a label will be described. The tape printer is provided by the user with an indication that a new label is to be begun in any of the ways already described. The user inputs his label using the keyboard 106. The user is then able to print the label by actuating a print key or the like.

To enter another label, the user provides the tape printer with the indication that a new label is to be begun. This indicator 210 indicates the end of the previous label and the beginning of the next label. The user inputs his next label, again using the keyboard 106. The user is able to select which of the labels are printed by moving the cursor using the cursor control keys 74. The location of the cursor determines which of the labels is printed. In particular, the label in which the cursor is currently located determines the label which is printed when the print key is actuated. Additionally, as the cursor is moved, the label or part of the label which is displayed will change. The display 108 will display the label or part of the label in which the cursor is currently displayed.

The user is able to continue adding labels in the manner described above until the buffer is full. In one embodiment of the invention, the new label will always be added to the end of the buffer. In alternative embodiments of the present invention, the new label will be added at a position defined by the current position of the cursor.

The cursor can be moved through the edit buffer character by character. In some embodiments of the present invention, the cursor can be controlled to move from one label to the next. For example, activation of the cursor key in conjunction with the shift key would cause the cursor to be moved to the next label. This can be the preceding or succeeding label depending on the direction of movement associated with the cursor key. Where this function is provided, it is preferred that the cursor be moved to a predetermined position in the next label. This can be the beginning or end of the next label and may be dependent on whether the next label is a preceding or succeeding label.

If the buffer is full, the user will be prevented from inputting a new label or to finish the current label. The tape printer may display a message or provide an alternative indication to the user that the edit buffer is full. If the user wishes to continue inputting the current label or to input a new label, the user will then have to delete one or more of the labels which are currently stored in the edit buffer. The user is able to do this by moving the cursor to the label to be deleted. The user in some embodiments of the invention will need to delete the label character by character. In alternative embodiments of the present invention, the user is able to mark part or all of the label and delete the marked label. It may in some embodiments of the present invention be possible to delete an entire label at the same time.

In an alternative embodiment of the present invention, the user is able to over write the buffer if there is no longer any room. The user may be given a warning that the buffer is about to be over written in order to give the user the option of whether or not to keep the label which is to be over written.

In preferred embodiments of the present invention, each label can have its own attributes. Thus different labels may use different sizes of characters and different sizes of characters. Some labels may have boxes around the label whilst other labels may not. Different styles of boxes may be provided for different labels. Some labels may also include one or more carriage return symbols to partition the text over two or more printed lines.

The label attribute information may be stored as invisible data 212 at the beginnig of each label. By invisible, it is meant that the data is stored in the edit buffer 200 but is not displayed. This information can take up the space of one or more characters in the buffer. In preferred embodiments of the information, the space occupied by the attribute information is the same size as that occupied by a single character. In other words, this information is not displayed as part of the contents of the edit buffer. However, in some embodiments the way in which the label is displayed on the display may take into account the stored attributes. The label may be displayed in the same or similar form to that in which it is printed. In some embodiments of the present invention, indicators may be provided on the display to indicate to the user the attributes with which a label will be displayed. It should be appreciated that in alternative embodiments of the present invention, the attribute information may be stored Alternatively the attribute information for different labels may be stored together in a single location of the edit buffer, for example at the beginning or end of the buffer.

Figure 6:
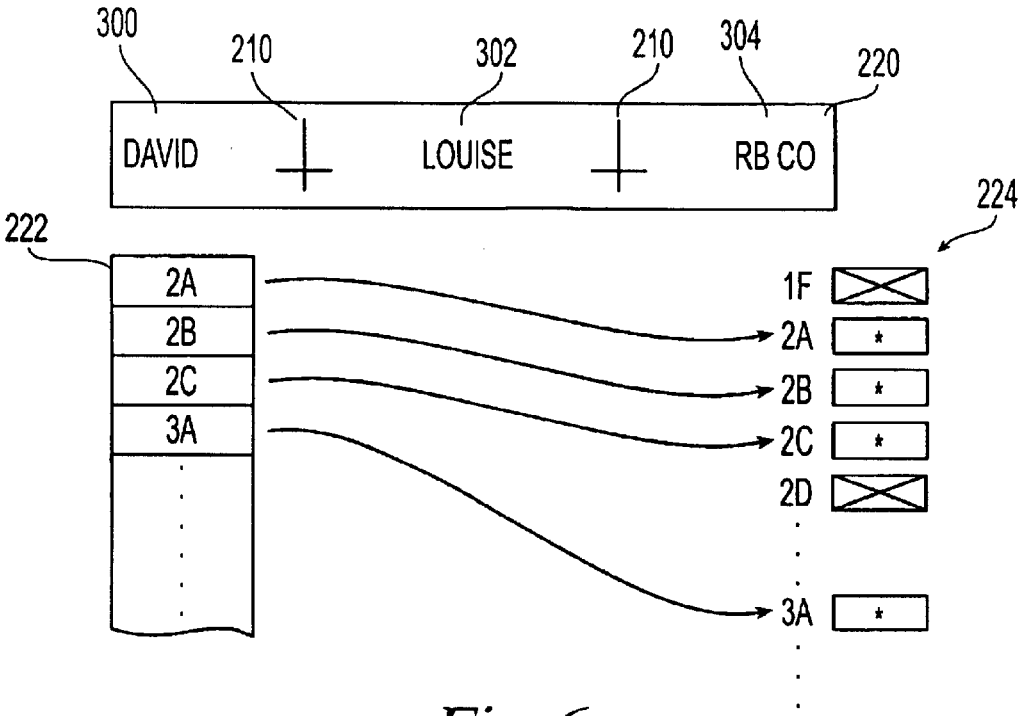
FIG. 6 shows a variation of the edit buffer of FIG. 5.

In one modification to the present invention, memory locations outside the edit buffer are used to store attribute information. This is shown in FIG. 6 which will now be described. This has the advantage that the amount of text stored in the edit buffer can be maximized as the attribute information does not need to be stored in the edit buffer. Additionally, all of the characters or information including the label delimiter can be displayed. This simplifies the control of the display.

Reference is made to FIG. 6 which illustrates this embodiment in more detail. The edit buffer 220 is provided with labels 300 to 304 respectively. The user enters the characters into the labels as described hereinbefore. The label delimiter or indicator 210 is entered as required whenever a new label is begun.

A ROM table 222 is provided to point to each location 224 in turn that is used to store the style information. The style information is stored in RAM other than the edit buffer. The ROM table 222 is used if the RAM locations are not contiguous so that an index is required to find them. For example, the first label 300 has its attribute information stored, according to the ROM table 222 in location 2A. The second label 302 has its attribute information stored in location 2B. If the edit buffer had a fourth label, its attribute information would be stored in location 3A. This is not contiguous with the previous location for the third label which is location 2C. A "i" is used to mark the locations where attribute information is store and "X" to mark those locations where attribute information is not stored.

It should be appreciated that instead of or as well as the style information, the text information can be stored in separate locations identified by the ROM table or the like. In one modification, all the labels in the edit buffer would share the same attributes. This has the advantage that only one set of attributes would need to be stored in the edit buffer. This would maximize the amount of space in the edit buffer for labels.

In one embodiment of the present invention, it possible to print out the entire contents of the edit buffer. The different labels may be separated from one another or be printed continuously on the tape with no cuts arranged between the separate labels. Instead of being separate labels, a partial cut may be provided between the labels. This mode of operation may be achieved by actuating the print key in conjunction with one or more other keys or could be achieved by actuating the print key for a longer period of time than would be required to print a single label.

Printing out of all of the labels may be selected when there are multiple labels having incompatible styles. For example a box-type of either the first label in the buffer or the label where the cursor currently is located can be used to box the entire label including all the labels. Alternatively, each label may be printed out with its own attributes.

In some embodiments of the present invention, the indicator 210 can be deleted in a similar way to a normal character. This would mean that the labels on either side of the indicator would become a single label.

In general the second label is joined to the first label when the delimiter is deleted and the second label inherits the attributes of the first label. Because the two labels are often not strictly compatible the exceptions may be handled as required. For example, if two labels each with two lines are joined, the result has only two lines but the new label has two carriage return (CR) symbols Indicating there should be 3 lines. All text after the first carriage return may be placed on the second line and is printed with a mark indicating the position of the second carriage return in the label. Another example is where two labels having incompatible fonts are joined. A default font may be used. In another example, a first label with a box is joined to a second label with two lines. The box may be canceled or the two boxes may be replaced by a single box.

Similarly, the indicator may be inserted in a similar way to a normal character. This would divide a label into two labels. It should be appreciated that the indicator would not be printed in preferred embodiments of the present invention.

The length of the edit buffer can have any suitable size.

Figure 7:
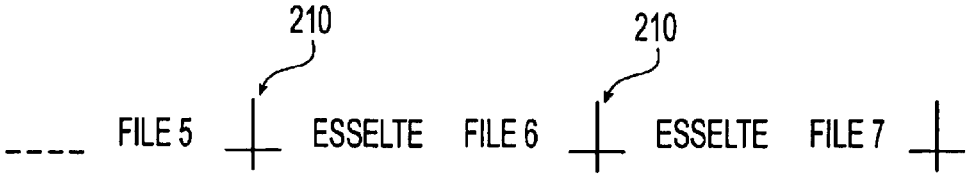
FIG. 7 is another example of the contents of the edit buffer.
Figure 8:
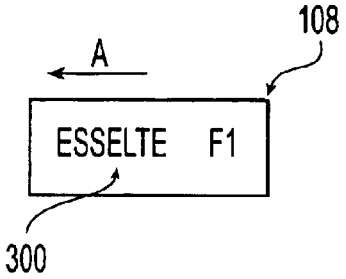
FIG. 8 is a diagram of the display showing one label.

The label indicators 210 can be used to control display of the labels in the buffer on the liquid crystal display 108. Assume that the contents of the edit buffer comprise a plurality of labels such as illustrated in FIG. 7. The labels are separated by label indicators 210 as already described with reference to FIG. 5. FIG. 8 illustrates the display 108 showing the position of the cursor 300 located under the label with the contents ESSELTE FILE 6. When the user depresses a scroll key on the keyboard 106, that label is scrolled across the display in the direction of arrow A. Scrolling commences at the label indicator 210 at the front of the label and ceases at the label indicator 210 at the termination of the label. Thus, the complete label between the indicators 210 can be viewed even if it is longer than this display itself.

A separate function entitled "view" can also be implemented. When that function is selected using appropriate key strokes, for example by depression of a VIEW key on the keyboard 106, the entire contents of the buffer are scrolled in the direction of arrow A across the display. When this is done, a user can select a particular label for printing by depression of a selection key such as a cursor key when the label which he wishes to select is displayed.

As described above, the contents of the buffer may be cleared in their entirety by implementing a clear function. As alternatively described above, a selected label can be clear by itself by location of the cursor 300. The limits of the label to be deleted in that respect are defined by the label indicators 210.

As described above, adjacent labels can be conjoined by deletion of the intermediate indicator 210. In that case, a "best effort" can be made to print the resulting label Alternatively, the resulting label can be checked against print parameters and, if it is not possible to print an adequate label, an error message can be generated at the display 108.

It should be appreciated that whilst the preferred embodiments of the present invention have been described in the context of tape printers, alternative embodiments of the present invention may be used with other text processing devices or printers.

What is claimed:

1. A label printer for printing a label, the printer comprising:

input means for inputting data defining labels to be printed;

storage means for storing a plurality of labels, said labels being separated in said storage means by label indicators;

selection means for selecting at least one of said labels to be displayed at a display of the label printer; and means for controlling only said selected label to be displayed in dependence on the location of label indicators defining the limits of said selected label.

2. A label printer according to claim 1, wherein the control means is operable to control said display to show the selected label by scrolling across the display.

3. A label printer according to claim 1, wherein the input means comprises means for selecting a view function according to which all the labels stored in the storage means are displayed by scrolling across the display means.

4. A label printer according to claim 1, wherein said storage means comprises an edit buffer.

5. A label printer according to claim 1, wherein said input means comprises a keyboard.

6. A label printer according to claim 1, wherein said selection means comprises a cursor controllable at the input means.

7. A label printer according to claim 1, which comprises printing means for printing said at least one selected label.

8. A label printer according to claim 1, wherein the input means comprises means for selecting a clear function according to which a selected label can be deleted from the storage means.

9. A label printer according to claim 1, wherein the label indicator is deletable to conjoin adjacent labels in the storage means.

10. A label printer according to claim 9, which comprises means for generating an error message when the conjoined label is not printable.

11. A label printer according to claim 1, wherein said display means is arranged to display an indicator which indicates the end and/or beginning of a label.

12. A label printer according to claim 1, wherein said label printer having a first mode of operation in which a plurality of labels is storable in said memory means and a second mode of operation in which only label is storable in said memory means at a time.

13. A method of displaying contents of a label memory which holds a plurality of labels, the method comprising:

selecting one of said labels at a display;

detecting a first label indicator in the label memory and commencing automatic scrolling operation at said first label indicator to scroll the contents of the label from right to left across the display; and terminating the scrolling operation on detection of a subsequent label indicator defining the end of the selected label such that the selected label is displayed in dependence on the location of the label indicators defining the limits of the selected label.

14. A label printer for printing a label, said printer comprising:

input means for inputting labels to be printed;

memory means for storing a plurality of labels, said memory means being arranged to store said labels as said labels are input, wherein the memory means is arranged to store at least one delimiter, said delimiter separating labels, and wherein said delimiter is deletable to combine a plurality of said labels into a combined label;

selection means for selecting at least one of said labels to be printed; and printing means for printing said at least one selected label.

15. A label printer as claimed in claim 14, wherein said memory means comprises an edit buffer.

16. A label printer as claimed in claim 14, wherein said memory means is arranged to store attribute information associated with at least one of said labels.

17. A label printer as claimed in claim 16, wherein respective attribute information is stored in said memory means as part of said plurality of labels.

18. A label printer as claimed in claim 14, wherein attribute information associated with at least one of said labels is stored in a different memory location to said memory means.

19. A label printer as claimed in claim 18, wherein a table is provided to permit the attribute information associated with a given label to be retrieved.

20. A label printer as claimed in claim 19, wherein the number of labels storable in said memory means is dependent on the respective lengths of said label.

21. A label printer as claimed in claim 14, wherein said labels are of variable length.

22. A label printer as claimed in claim 14, wherein said memory means has a maximum number of labels which can be stored therein at the same time.

23. A label printer as claimed in claim 14, wherein said input means comprises a keyboard.

24. A label printer as claimed in claim 14, wherein said selection means are controlled by said input means.

25. A label printer as claimed in claim 14, wherein said selection means comprises cursor means.

26. A label printer as claimed in claim 25, wherein the label in which said cursor means is located is selected and printed.

27. A label printer as claimed in claim 25, wherein said cursor means is controllable to move from one label to the next in successive cursor operations.

28. A label printer as claimed in claim 14, comprising a mode of operation whereby the entire contents of said memory means is printed.

29. A label printer as claimed in claim 14, wherein said label printer is arranged to print on a tape.

30. A label printer as claimed in claim 14, wherein said combined label has one or more attributes of a first one of the plurality of labels.

31. A label printer as claimed in claim 14, wherein said combined label has at least one default setting.

32. A label printer as claimed in claim 30. wherein at least one attribute of the first and second labels of said plurality of labels is remove from said combined label.

33. A label printer as claimed in claim 14, wherein a label delimiter is automatically sided to the end of a label when said label is printed.

34. A label printer as claimed in claim 14, wherein the next label is stored automatically after the automatically added delimiter.

35. A label printer as claimed in claim 34, wherein a display is provided for displaying at least part of the contents of said memory means.

36. A label printer as claimed in claim 14, wherein a display is arranged to display an indicator which indicates the end and/or beginning of a label.

37. A label printer as claimed in claim 14, wherein an indicator of a new label is input via said input means.

38. A label printer for printing a label, the printer comprising:

an input for inputting and for changing label data, said label data comprising characters, printing attributes, and label indicators;

a storage buffer for storing a plurality of labels, wherein said labels are separated one from another by a label indicator;

a display for displaying labels stored in the storage buffer, said display showing at least one label indicator if a plurality of labels are displayed;

a selector for selecting at least one character or label indicator in said display, said selector activating the character or the label indicator for changing by the input means; and a printer for printing the label containing the selected character or characters.

39. A label printer for printing a label, said printer comprising:

input means for inputting labels to be printed;

memory means for storing a plurality of labels, said memory means being arranged to store said labels as said labels are input;

selection means for selecting at least one of said labels to be printed; and printing means for printing said at least one selected label, wherein said display is arranged to display an indicator which indicates the end and/or beginning of a label.

40. A label printer for printing a label, said printer comprising:

input means for inputting labels to be printed;

memory means for storing a plurality of labels, said memory means being arranged to store said labels as said labels are input;

selection means for selecting at least one of said labels to be printed; and printing means for printing said at least one selected label, wherein and indicator of a new label is input via said input means.

41. A method of displaying contents of a label memory which holds a plurality of labels, the method comprising:

inputting data defining labels to be printed;

storing a plurality of labels, said labels being separated by label indicators;

selecting at least one of said labels to be displayed at a display of the label printer; and controlling only said selected label to be displayed in dependence on the location of label indicators defining the limits of said selected label.

* * * * *